US008128012B2

(12) United States Patent
Aoki et al.

(10) Patent No.: US 8,128,012 B2
(45) Date of Patent: Mar. 6, 2012

(54) APPARATUS FOR RECLAMATION OF MOLDING SAND

(75) Inventors: Yukinori Aoki, Fukuoka (JP); Junichi Iwasaki, Toyokawa (JP); Yutaka Hagata, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 0 days.

(21) Appl. No.: 12/746,482

(22) PCT Filed: Dec. 1, 2008

(86) PCT No.: PCT/JP2008/071786

§ 371 (c)(1),
(2), (4) Date: Jun. 4, 2010

(87) PCT Pub. No.: WO2009/072459

PCT Pub. Date: Jun. 11, 2009

(65) Prior Publication Data

US 2010/0276528 A1 Nov. 4, 2010

(30) Foreign Application Priority Data

Dec. 7, 2007 (JP) ..... 2007-316797
Apr. 1, 2008 (JP) ..... 2008-094592

(51) Int. Cl.
*B02C 25/00* (2006.01)

(52) U.S. Cl. ..... 241/37; 241/101.3; 241/601

(58) Field of Classification Search ..... 241/601, 241/37, 101.3

See application file for complete search history.

(56) References Cited

FOREIGN PATENT DOCUMENTS

| | | | |
|---|---|---|---|
| JP | 64-077694 | A | 3/1989 |
| JP | 05-329391 | | 12/1993 |
| JP | 07-256390 | | 10/1995 |
| JP | 08-57579 | A | 3/1996 |
| JP | 2000-126633 | | 5/2000 |
| JP | 2001-321892 | A | 11/2001 |

OTHER PUBLICATIONS

International Search Report dated Feb. 24, 2009 corresponding International Application No. PCT/JP2008/071786.

*Primary Examiner* — Mark Rosenbaum
(74) *Attorney, Agent, or Firm* — Finnegan, Henderson, Farabow, Garrett & Dunner, L.L.P.

(57) ABSTRACT

An apparatus for the reclamation of molding sand by which the quality of the reclaimed molding sand is enhanced. The apparatus for reclamation of molding sand includes a part for feeding the molding sand 1, which part has a sand falling port at its bottom, a rotary drum 2 disposed below the part for feeding the molding sand 1 and being rotatable horizontally, a motor driving means 4 for rotating the rotary drum 2 by an electric motor 3, a roller 5 disposed in the rotary drum 2 and spaced apart therefrom, and a cylinder 6 connected to the roller 5 that presses the roller 5 toward the rotary drum 2. It further includes a flow detector for the sand A disposed at the sand falling port of the part for feeding the molding sand and for detecting the flow of the sand fed into the rotary drum; a current detector B for detecting the current of the motor driving means; a pressure controller C for controlling the pressure of the cylinder; and a controller D for controlling the force of the cylinder 6 that is pressing the roller 5 based on the flow of the sand detected by the flow detector for the sand A.

5 Claims, 3 Drawing Sheets

APPARATUS FOR RECLAMATION OF MOLDING SAND

TECHNICAL FIELD

The present invention relates to an apparatus for reclamation of molding sand. Specifically, it relates to one for reclamation of molding sand by which the quality of the reclaimed molding sand is enhanced.

BACKGROUND ART

A conventional apparatus for reclamation of molding sand has been known, such as one disclosed in Japanese Patent No. 3125276. It comprises a chute for falling sand. The chute has a sand falling port at its bottom. The apparatus comprises a rotary drum, which is disposed below the chute and rotatable horizontally. It has an inclined circumferential wall extending from a circular bottom plate to the upper-outward direction. A ring portion (gate) extends inwardly from the upper end of the inclined circumferential wall. The apparatus also comprises a roller, which is disposed horizontally in the rotary drum and slightly spaced apart from the inclined circumferential wall. It also comprises a mechanism for pressing the roller toward the inclined circumferential wall by a predetermined pressure.

It employs a system to remove deposit from the surfaces of sand by pressing the sand by the roller. The sand is continuously fed into the rotary drum and is piled on the inner surface of the inclined circumferential wall of the drum by centrifugal force. The roller presses the piled sand to remove its deposit.

Because it has no function to control the pressure of the roller, the properties of the sand vary widely depending on the production line. When the flow of the sand fed into the apparatus changes, the current of a motor for driving the rotary drum changes. Thus, if the driving force of the motor is not appropriate to the flow of the sand, it is difficult to maintain an adequate quality of the molding sand reclaimed by the apparatus.

At the same time, a method of controlling the operation of a vertical crushing machine is proposed in Japanese Patent Application No. 2000-126633. In the method, at any time a specific pressure is monitored. The specific pressure is the ratio of the pressure applied from the crushing roller to the turntable to the thickness of raw materials between the crushing roller and the turntable. When the amount of supplied raw materials to the turntable changes, the specific pressure is controlled to be uniform by comparing the monitored specific pressure to a predetermined one. By doing so, the vibrations of the machine are reduced and the desired grain sizes are efficiently obtained.

DISCLOSURE OF INVENTION

However, in the method of controlling the operation, the thickness of the raw materials and the pressure are used as parameters. Because various molding processes are used, it is difficult to provide a certain formula or factor that relates to the quality of the reclaimed molding sand for such processes. This has been a problem.

The flow of the sand fed into the machine can be measured only when the machine stops. Thus, any change of the flow of the sand that may occur during the operation cannot be measured. Therefore, the operation cannot correspond to the flow of the sand fed into the machine when the flow is internally or otherwise changed. This has been a problem.

To solve the problems, the object of the present invention is to provide an apparatus for reclamation of molding sand by which its quality is enhanced.

The apparatus for reclamation of molding sand of the present invention comprises a part for feeding the molding sand. That part has a sand falling port at its bottom, a rotary drum disposed below the part for feeding the molding sand and rotatable horizontally, a driving motor for rotating the rotary drum by an electric motor, a roller disposed in the rotary drum and spaced apart therefrom, and a cylinder means having a cylinder connected to the roller and pressing the roller toward the rotary drum. The apparatus is characterized in that it further comprises a flow detector for the sand disposed in the outlet for the molding sand of the part for feeding the molding sand. It detects the flow of the sand fed into the rotary drum. The apparatus further comprises a current detector for detecting the current of the motor; a pressure controller for the cylinder; and a controller for controlling the force of the cylinder pressing the roller based on the flow of the sand detected by the flow detector.

By the present invention, since the force of the cylinder pressing the roller is controlled based on the current of the driving motor, which changes corresponding to the flow of the sand detected by the flow detector, the operation can be controlled to correspond to the amount of deposit that remains on the surfaces of the sand, such as old and decayed binders. Thus, the quality of the reclaimed molding sand is enhanced.

The basic Japanese patent applications, No. 2007-316797, filed Dec. 7, 2007, and No. 2008-094592, filed Apr. 1, 2008, are hereby incorporated by reference in the present application in their entirety.

The present invention will become more fully understood from the detailed description given below. However, the detailed description and the specific embodiment are illustrations of desired embodiments of the present invention, and are described only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein, is intended merely to better illuminate the invention, and so does not limit the scope of the invention, unless otherwise claimed.

BEST MODE FOR CARRYING OUT THE INVENTION

Figure 1:
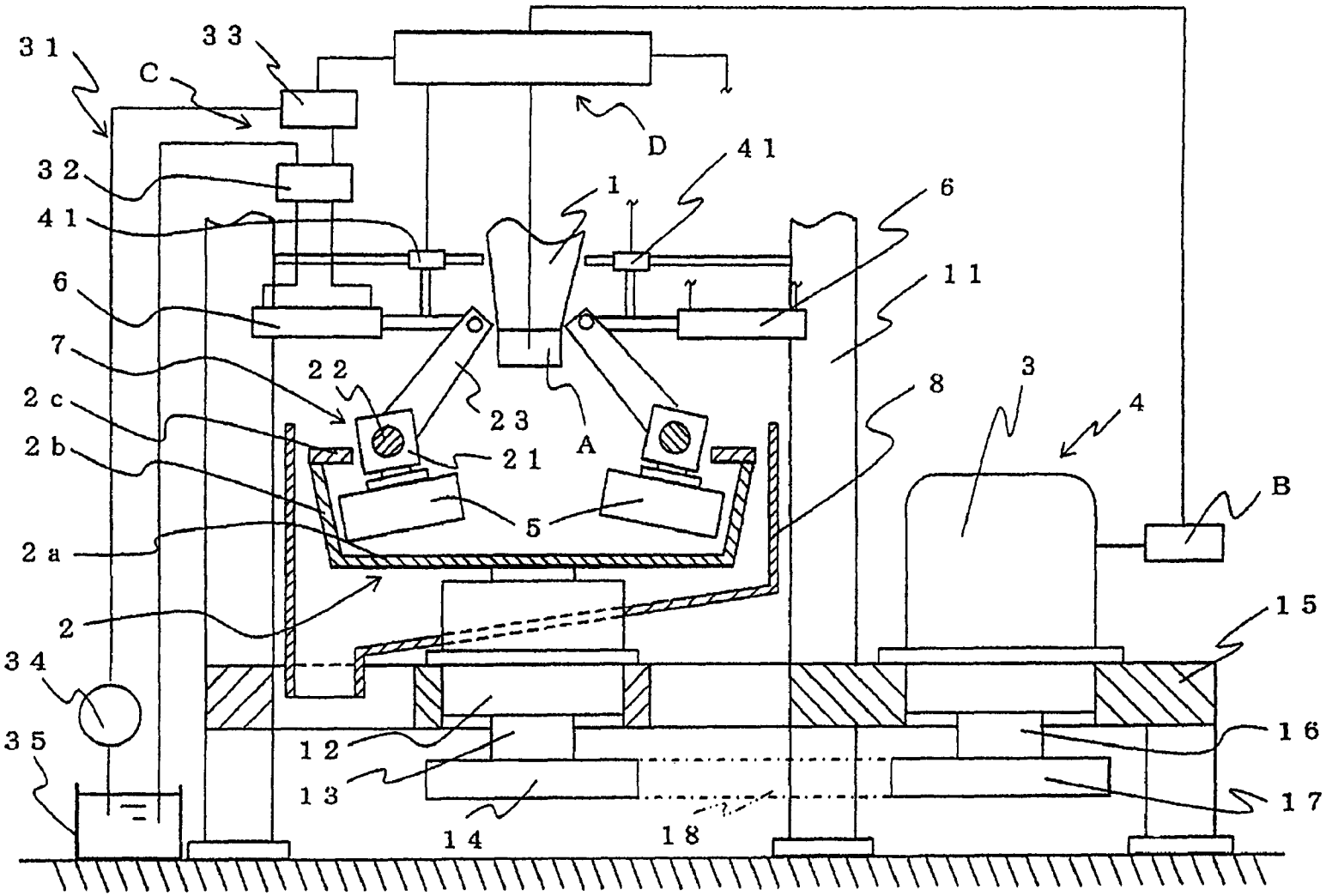
FIG. 1 is a block diagram of the apparatus for reclamation of the molding sand according to the present invention.

Below, the apparatus for reclamation of the molding sand of the present invention will be described with reference to the drawings. As shown in FIG. 1, one embodiment is an apparatus for reclamation of the molding sand that comprises a part for feeding the molding sand 1. The part has a sand falling port at its bottom, a rotary drum 2 disposed below the part for feeding the molding sand 1 and being rotatable horizontally, a motor driving means 4 for driving the rotary drum 2 by a motor 3, rollers 5 disposed in the rotary drum 2 and spaced apart from it, and a cylinder means 7 having cylinders 6 connected to the rollers 5 and pressing the rollers 5 toward the rotary drum 2. The apparatus further comprises a flow detector for the sand A for detecting the flow of the sand fed into the rotary drum, a current detector B for the motor driving means 4, a pressure controller C for the cylinders 6, and a controller D. An embodiment of the present invention is not limited to the apparatus of FIG. 1.

The rotary drum 2 has a circular bottom plate 2*a*, an inclined circumferential wall 2*b* extending from the rim of the circular bottom plate 2*a* in the upper-outward direction, and a ring portion (gate) 2*c* inwardly extending from the upper end of the inclined circumferential wall 2*b*. These parts are integrated. The rollers 5 are located so as to keep small spaces between themselves and the inclined circumferential wall 2*b*.

A chute 8 is placed to enclose the rotary drum 2. Thus, the sand (the reclamation sand) flows over the ring portion (gate) 2*c* to be collected by the chute 8 after it has been reclaimed in a shear action under a uniform pressure applied by the rollers 5. Then it is collected in a processing tank (not shown).

The motor driving means 4 may be configured so that the rotary drum 2 is driven by the motor 3 and a belt, but it is not limited to this configuration. In the embodiment, a rotary shaft 13 is fixed to the center of the lower surface of the circular bottom plate 2*a* of the rotary drum 2. The shaft 13 is pivotally supported by a bearing 12. The bearing 12 is attached to a portal frame 11. A pulley 14 is attached to the bottom end of the rotary shaft 13. The motor 3 is attached to a frame 15 in the area outside the main body, such as the rotary drum 2, of the apparatus for reclamation of the molding sand. A pulley 17 is attached to the rotary shaft 16 of the motor 3. A belt 18 binds the pulley 14 and the pulley 17. Thus, the rotary drum 2 is driven by the motor 3

The cylinder means 7 may have any configuration if the cylinders 6 can press the rollers 5 toward the inner surface of the rotary drum 2. In the embodiment it comprises fittings 21 fixed to the upper surfaces of the rollers 5, shafts 22 inserting into the respective fittings 21 to support them, arms 23 connected to the respective shafts 22, and the cylinders 6 connected to the respective arms 23. The rods of the cylinders 6 are rotatably connected to the upper ends of the arms 23. Though two rollers 5 are installed in the embodiment, the number of rollers 5 may be arbitrarily determined.

Any detector may be used as the flow detector for the sand A if it can be disposed at the molding sand falling point of the part for feeding the molding sand 1 and can detect the flow of the sand that is fed into the rotary drum 2. For example, a device for measuring the change of the momentum of the sand falling from a constant height by using a load cell can be used as it.

Any detector may be used as the current detector B if it can detect the current of the motor driving means 4. For example, a device for transforming the signal from a current transformer to digital data can be used. The current transformer is used for the indication of the current.

Any devices may be used as the pressure controller C if they can control the pressure of the cylinders 6. In the embodiment, each of them comprises a solenoid selector valve 32 connected to a hydraulic piping 31, a pressure-control valve 33, a hydraulic pump 34, and a pressure-oil tank 35. The pressure-control valve 33 controls the pressure of the incoming oil so that it is proportional to the signal output by the controller D. Then, it feeds the oil to the cylinder 6. Though in the embodiment the cylinder 6 is a hydraulic cylinder, it may be any cylinder such as an air cylinder, a cylinder using both air pressure and oil pressure, or an electric cylinder. In such a case, a mechanism to control the pressure caused by the cylinder may be adapted to the type of cylinder.

The controller D is configured to control the pressure of the rollers 5 caused by the cylinders 6 depending on the flow of the sand detected by the flow detector for the sand A.

In the embodiment the controller D comprises a calculating part for a desired current, a comparing part, and a controlling part. The calculating part for the desired current calculates the current of the motor 3 based on the flow of the sand detected by the flow detector for the sand A so as to maintain the predetermined relationship between the flow of the sand fed into the rotary drum 2 and the current of the motor 3, which current corresponds to the flow of the sand. The comparing part compares the actual current of the motor 3 to the desired current corresponding to the flow of the sand. The controlling part controls the pressure of the roller 5 caused by the cylinders 6 so as to shift the actual current of the motor 3 closer to the desired current, based on the comparison of the comparing part. In particular, a subtractive feedback value is calculated. That is, a voltage to be increased, a voltage to be decreased, or the maintenance of the present voltage, is calculated so as to shift the present current closer to the desired current.

For the relationship, the desired current is the current of the motor 3 that is required to reclaim the sand of the flow fed into the rotary drum 2. The desired current depends on the flow determined by the operating conditions of the apparatus for reclamation of the molding sand. It also depends on the current corresponding to the degree that the reclaimed molding sand is polished. For example, the current is 80-100 A for sand that is easily polished and 100-120 A for sand that is polished with difficulty.

Figure 2:
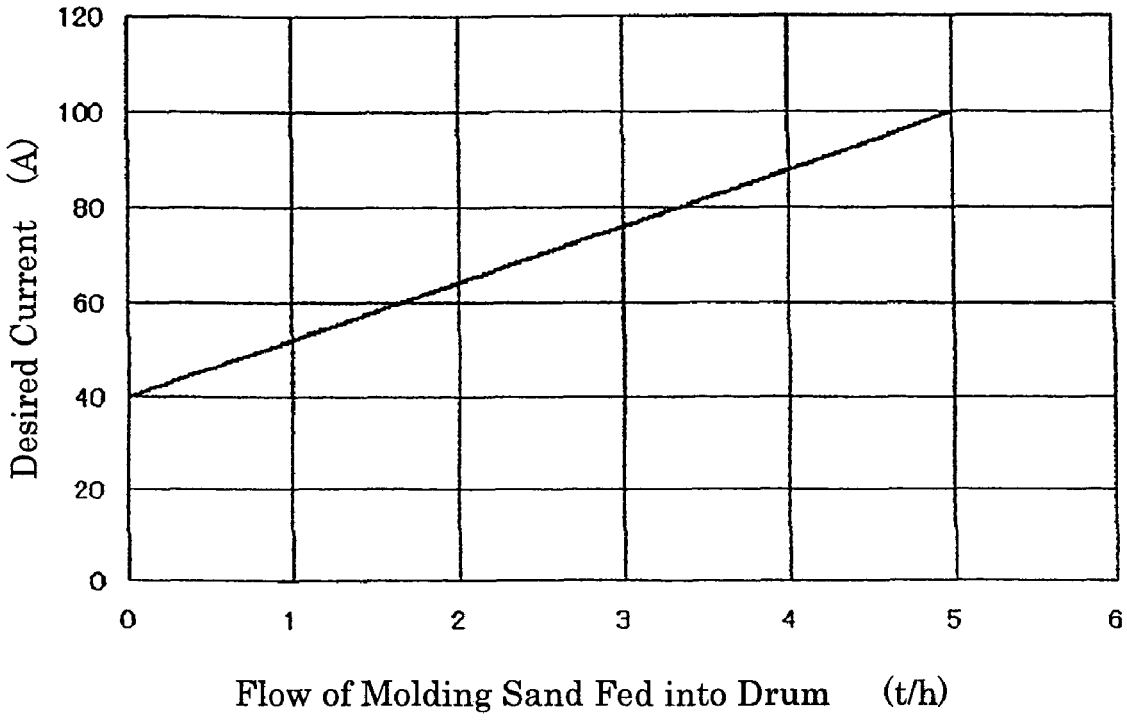
FIG. 2 is a diagram showing the relationship between the flow of sand fed into the rotary drum and the desired current of the motor.

As an example, an apparatus having the capacity of 2-5 t/h is considered. As shown in FIG. 2, the current of the motor 3 required for reclamation of the sand of a flow of 5 t/h is assumed to be 100 A. When the flow of the sand fed into the rotary drum 2 is 4 t/h, the desired current of the motor 3 corresponding to the flow of the sand is 88 A. In this example, when the flow of the sand is decreased from 5 t/h to 4 t/h, the pressure of the rollers 5 caused by the cylinders 6 is controlled so as to shift the current of the operating motor 3 closer to the desired current, 88 A.

Though the relationship between the flow of the sand and the current is represented as linear, the control may be similarly performed for a non-linear relationship.

The comparing part preferably includes a part or device for calculating an increasing or decreasing rate of the pressure of the rollers 5 caused by the cylinders 6 after comparing the measured current of the operating motor 3 to the desired current, which corresponds to the flow of the sand. For example, the increasing or decreasing rate, which is calculated by equation (1), is calculated at every second to control the pressure caused by the cylinder 6. The "sensitivity factor" in equation 1 is a factor to moderate the change of the increasing or decreasing rate. For example, it may be set at 0.2.

$$\text{The increasing or decreasing rate}=(\text{the desired current/the measured current}-1)\times\text{the sensitivity factor}+1 \quad (1)$$

A specific example of the calculation of the pressure is now given. Assuming the desired current=88 A, the measured current=80 A, and the sensitivity factor=0.2, the increasing or decreasing rate=(88/80−1)×0.2+1=1.02. When the desired pressure is 100 kPa, that one second thereafter is 100×1.02=102 kPa.

In the embodiment, as an additional function the controller D includes a means for calculating the accumulated weight of the reclamation sand. This means calculates the accumulated weight of the reclamation sand by integrating the flow of the sand over an operating time. The flow of the sand is measured by the flow detector for the sand A.

An example of the method of integrating the measured flow of the sand over an operating time is shown in equation (2). The sampling time of the flow is set at one second. A subtotal of the weight of the sand at the time for initiating the reclamation is set at zero. The subtotal is calculated at every second by equation (2).

$$\text{The subtotal of sand} = \text{the subtotal of sand} + \text{the flow of the sand per hour} \times 1/3600 \quad (2)$$

After integration of the subtotal of the sand during each operation, the accumulated weight of the reclamation sand at the completion of the operation (the accumulation of the sand) is calculated by equation 3.

$$\text{The accumulation of the sand} = \text{the accumulation of the sand} + \text{the subtotal of the sand} \quad (3)$$

A process for calculating the accumulation is divided into two steps so as to maintain the high accuracy of the calculation.

For example, assume the reclamation of the sand at 2-5 t/h. The flow of the sand is 0.6–1.4 kg/s. When the operation is 2,000 hours per year, the amount of the sand is (0.6–1.4)×3600×2000=4,320,000–10,080,000 kg.

When the calculation with a floating decimal point is performed using seven significant digits, it is accurate for a smaller accumulation.

The result of the calculation may exceed the maximum value of the seven significant digits if the accumulation is not reset to zero for a long time. In this case, any digit below the significant digits is ignored. Thus, nothing is added to the accumulation.

Therefore, the subtotal is calculated for each operation to increase the value by three digits or so. Then the value is added to the accumulation to maintain the high accuracy of the calculation.

The accumulated weight of the reclamation sand that is calculated is displayed on a display such as a personal computer or a graphic touch panel or is stored in a memory card, etc.

In the embodiment the information (the data) for the accumulated weight of the reclamation sand may be used to control the amount of the sand in a process of making a mold or to control the timing to replace expendable parts such as the rollers 5 or the rotary drum 2.

Figure 3:
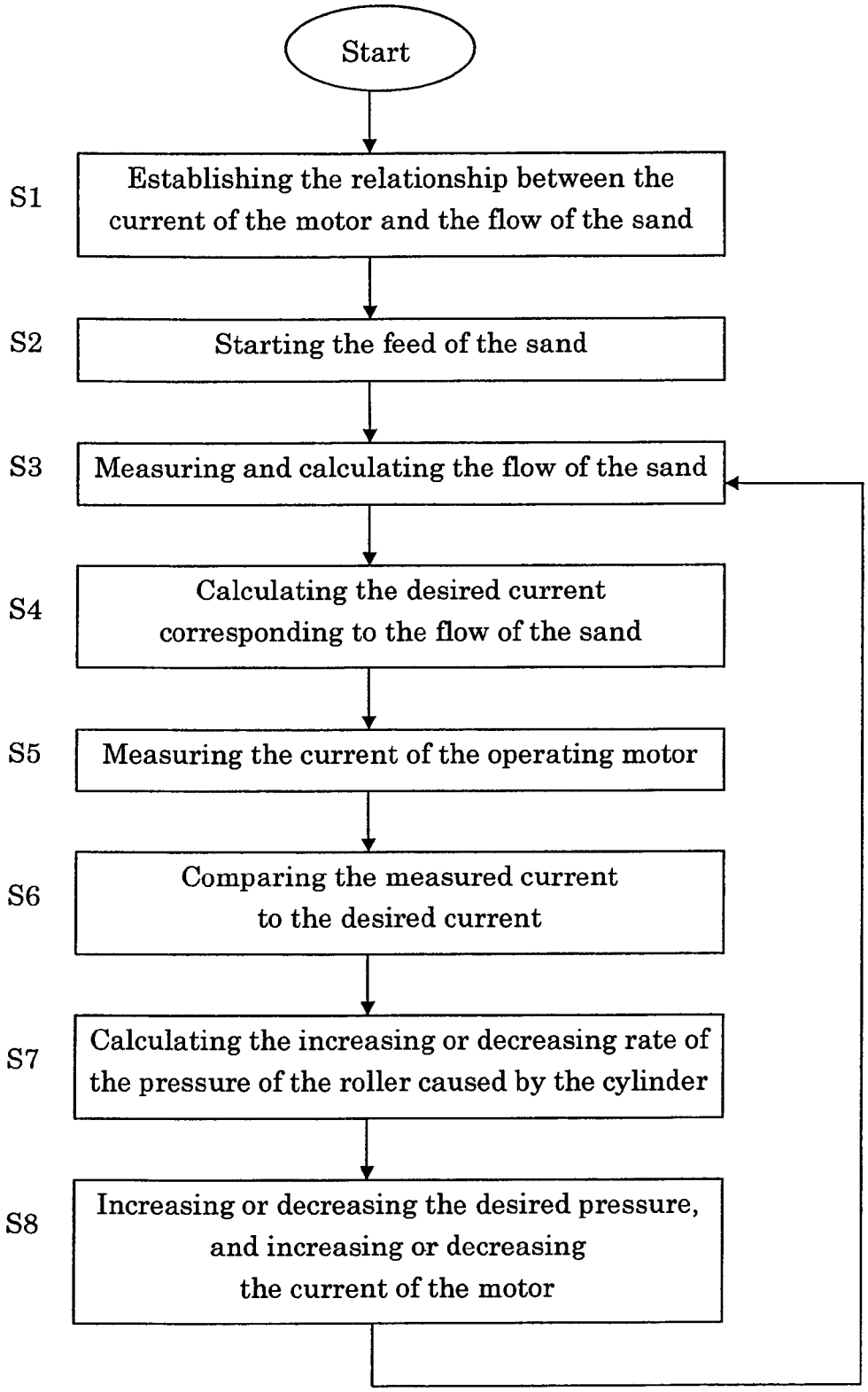
FIG. 3 is a flowchart of the method of reclamation of the molding sand of the present invention.

Below a working example of the invention is described with reference to FIGS. 2 and 3. The scope of the invention is not limited to the example.

Example

The apparatus having the capacity to reclaim the sand of the flow of 5 t/h is used for the example. The desired current of the motor is set at 100 A. The relationship between the flow of the sand fed into the rotary drum and the desired current of the motor corresponding to the flow is shown in FIG. 2.

And then, the relationship between the flow of the sand fed into the rotary drum and the desired current of the motor corresponding to the flow is established and stored (Step 1).

Next, the apparatus for reclamation of the molding sand is started up. The feed of the molding sand is started (Step 2).

Next, the flow of the molding sand at the time of the start of the cycle is calculated by the flow detector for the molding sand, which is disposed in the part for feeding the molding sand (Step 3).

Next, the desired current of the motor corresponding to the flow of the molding sand is calculated by using the relationship (Step 4).

Next, the current of the operating motor at that time is measured (Step 5). It is compared to the desired current of the motor corresponding to the flow of the molding sand (Step 6).

Next, the increasing or decreasing rate of the pressure of the rollers caused by the cylinder is calculated (Step 7).

Next, the desired pressure caused by the cylinder is increased or decreased by using the increasing or decreasing rate that is calculated by using equation (1) for the sampling time, such as one second. The current of the motor is increased or decreased. For example, the sensitivity factor may be set at 0.2 (Step 8).

In the embodiment, since the pressure caused by the cylinder is controlled so as to meet the desired current of the motor corresponding to the flow of the molding sand, the quality of the reclaimed molding sand is enhanced.

In the embodiment, some significant data of the apparatus for reclamation of the molding sand are stored during its operation. The operating conditions of the apparatus and any change in the properties of the molding sand are monitored by analyzing the data. If they are outside the allowable range, an alarm sounds. Thus, a big problem is prevented and the high quality of the reclaimed molding sand is maintained.

To monitor the data, they are displayed on the screen. If they are outside the allowable range, their cause and the strategy to deal with it are displayed.

The significant data include the flow of the molding sand fed into the rotary drum, the current of the motor, the desired extension of the cylinder, and the setting pressure of cylinder.

For example, extreme reduction of the flow of the molding sand may cause the rollers to rapidly heat up, and then be broken. Thus, the flow of the sand is monitored.

Since the current of the operating motor differs from the desired current, it is stored and monitored to control the fluctuation of the current.

If the indication of trouble is only displayed when the extension of the cylinder exceeds the allowable range (for example, 70-100 mm), the history is unknown. Thus, the data on the extension are stored. If the cylinder is extended while the properties of the sand and the pressure of the rollers are not changed, the rollers or the rotary drum may be worn out. Thus, the extension of the cylinder is monitored. It may be measured by disposing a position-sensing device such as a linear gauge 41 on the rod of the cylinder 6.

Since the pressure of the rollers is controlled within the allowable range, it is monitored.

Therefore, the apparatus of the embodiment preferably includes a part for storing the significant data throughout the operation, a part for determining if each stored datum is within the allowable range, and a part for sounding an alarm to make an adjustment when the part for determining shows that any datum is outside the allowable range.

The invention claimed is:

1. An apparatus for the reclamation of molding sand comprising:

a part for feeding molding sand, which part has a sand falling port at a bottom of the part for feeding the molding sand;

a rotary drum disposed below the part for feeding the molding sand and being rotatable horizontally;

a motor driving means for rotating the rotary drum;

a roller disposed in the rotary drum and spaced apart therefrom, and a cylinder connected to the roller that presses the roller toward the rotary drum;

a flow detector for the sand disposed at the sand falling port of the part for feeding the molding sand for detecting a flow of the sand fed into the rotary drum;

a current detector for detecting current of the motor driving means;

a pressure controller for controlling a pressure of the cylinder; and a controller for controlling a force of the cylinder pressing the roller based on the flow of the sand detected by the flow detector for the sand, wherein the controller comprises:

a calculating part for calculating a desired current of the motor driving means required for reclamation of the sand based on the flow of the sand detected by the flow detector for the sand;

a comparing part for comparing the current of the operating motor that is measured to the desired current corresponding to the flow of the sand; and a controlling part for adjusting the pressure of the roller caused by the cylinder to shift the current of the operating motor closer to the desired current based on a comparison of the comparing part.

2. The apparatus for the reclamation of molding sand of claim 1, wherein the comparing part includes a calculating device for calculating an increasing or decreasing rate of the pressure of the roller caused by the cylinder after comparing the measured current of the operating motor to the desired current corresponding to the flow of the sand.

3. The apparatus for the reclamation of molding sand of claim 1 or 2, further comprising:

a part for storing, throughout the operation, as significant data, data on the flow of the sand fed into the rotary drum, the current of the motor, any extension of the cylinder, and the pressure caused by the cylinder;

a part for determining if each significant data is within an allowable range; and a part for sounding an alarm if the determination shows that any of the significant data is outside the allowable range.

4. The apparatus for the reclamation of molding sand of claim 1 or 2, wherein the controller further comprises a means for calculating an accumulated weight of the reclamation sand by integrating a value detected by the flow detector for the sand over an operating time.

5. The apparatus for the reclamation of molding sand of claim 4, comprising a device for displaying and storing the data on the accumulated weight of the reclamation sand.

* * * * *